US007223376B2

(12) United States Patent
Panter et al.

(10) Patent No.: US 7,223,376 B2
(45) Date of Patent: May 29, 2007

(54) APPARATUS AND METHOD FOR MAKING CARBON FIBERS

(75) Inventors: Ronald L. Panter, Flushing, MI (US); Thomas A. Herold, Flushing, MI (US)

(73) Assignee: Industrial Technology and Equipment Company, Mnt. Morris, MI (US)

( * ) Notice: Subject to any disclaimer, the term of this patent is extended or adjusted under 35 U.S.C. 154(b) by 1142 days.

(21) Appl. No.: 09/780,303

(22) Filed: Feb. 9, 2001

(65) Prior Publication Data

US 2001/0033035 A1 Oct. 25, 2001

Related U.S. Application Data

(60) Provisional application No. 60/181,659, filed on Feb. 10, 2000.

(51) Int. Cl.
*D01F 9/12* (2006.01)

(52) U.S. Cl. ..... 423/447.6; 264/29.2

(58) Field of Classification Search ..... 423/447.1, 423/447.6; 264/29.2; 208/39
See application file for complete search history.

(56) References Cited

U.S. PATENT DOCUMENTS

| | | | | |
|---|---|---|---|---|
| 4,032,607 | A * | 6/1977 | Schulz | 156/148 |
| 4,389,387 | A * | 6/1983 | Miyamori et al. | 264/29.2 |
| 4,526,770 | A * | 7/1985 | Pepper et al. | 264/29.2 |
| 4,988,492 | A * | 1/1991 | Hara et al. | 264/29.2 |
| 5,004,511 | A * | 4/1991 | Tamura et al. | 156/242 |
| RE34,162 | E | 1/1993 | Boyd, Jr. | |
| 5,268,158 | A * | 12/1993 | Paul, Jr. | 264/29.2 |
| 5,316,654 | A * | 5/1994 | Berkebile et al. | 208/22 |
| 5,700,573 | A * | 12/1997 | McCullough | 423/447.1 |
| 5,733,484 | A * | 3/1998 | Uchida et al. | 264/29.1 |

OTHER PUBLICATIONS

K. Sen, S. Hajir Bahrami and P. Bajaj; High-Performance Acrylic Fibers; 1996; 39 pages; Department of Textile Technology, Indian Institute of Technology, New Delhi 110016, India.

A.K. Gupta, D.K. Paliwal, Pushpa Bajaj; Acrylic Precursors for Carbon Fibers; 1991; 44 pages; Centre for Material Science & Technology, Department of Textile Technology, Indian Institute of Technology, New Delhi 110016, India.

Katherine Shariq, Eric Anderson, Mario Jaeckel, Yasuhiko Sakuma; Carbon Fibers; 1995; 53 pagesCEH Marketing Research Report; Chemical Economics Handbook.

Alex James, CEO; Alex James and Associates Inc., Greenville, South Carolina; IFJ Feb. 1998; 1 page.

Mark Heschmeyer; US Academic Research into Carbon Fiber; IFJ Feb. 1998; 3 pages.

Mark Heschmeyer; Companies Take Fresh Look at Carbon Fibers; IFJ Feb. 1998; 2 pages.

Ralph Markee; Dwindling Supply of Rayon Yarn Precursor Puts Pressure on US Space, Military Programs; IFJ Feb. 1998; 1 page.

Carbon Fiber Corporate Update; IFJ Feb. 1998; 1 page.

John M. Crook, Pasco Inc; Custom-Designed Rolls Improve Production of Carbon Fibers; IFJ Feb. 1998; 2 pages.

Barmag Spinnzweirn; Precision Winder EKS 201C for Carbon Fiber; IFJ Feb. 1998; 1 page.

The Sahm 260 E-C Take-up Winder for Carbon Fiber; IFJ Feb. 1998; 1 page.

* cited by examiner

*Primary Examiner*—Stuart Hendrickson
(74) *Attorney, Agent, or Firm*—Reising, Ethington, Barnes, Kisselle, P.C.

(57) ABSTRACT

A method and apparatus for the carbonization of polyacrylonitrile (PAN) precursor fibers. The apparatus comprises a furnace, or series of furnaces in side-by-side arrangement. Each furnace includes a heater, an air inlet and an air diffusion plate. The fiber is located in the furnace above the air diffuser plate, such that heated air is evenly dispersed over the fibers. The method generally comprises the steps of heat treating the PAN precursor in an oxidizing environment to stabilize the fiber, and then further heat treating the stabilized fiber in an oxidizing environment to carbonize the stabilized fiber. The method can be carried out in a single furnace, or can be carried out in a series of furnaces in a continuous process.

9 Claims, 5 Drawing Sheets

42
58
44
8
40
46
56
10
14
52
54
30
22
28
12
24
48
16
19
20

APPARATUS AND METHOD FOR MAKING CARBON FIBERS

This application claims priority of U.S. provisional patent application No. 60/181,659 filed Feb. 10, 2000.

BACKGROUND OF THE INVENTION

1. Field of the Invention

The present invention relates an apparatus and method for making carbon fibers.

2. Invention Background

The present invention relates an apparatus and method for making carbon fibers.

Carbon fibers are known to be produced by the two-stage pyrolysis of rayon, polyacrlonitrile (PAN) or petroleum (or coal) pitch precursor fibers. Other synthetic fibers that have been considered as possible precursors for carbon fibers include aromatic polyamides, polyvinyl alcohol, polyphenylenes, polyvinyl chloride and polyoxadiazoles.

Generally, production of carbon fibers has been carried out by first heat treating precursor (raw) fibers in an oxidizing environment. Tension can be applied to the fibers during this heat treatment to retard fiber shrinkage and to maintain molecular orientation. This step is usually carried out at about 191 to 279 degrees Celsius for about one half hour to several hours. This step, known as stabilization forms chemical bonds that resist burning and increase the flash point of the fibers. Once the fiber is stabilized, it is further processed by carbonization through further heat treating in a non-oxidizing environment. Usually, the carbonization takes place at temperatures in excess of 525 degrees Celsius and in a nitrogen atmosphere.

The resultant carbon fibers are primarily fibers having in excess of 92 percent carbon. Higher carbonization temperatures can be used and can result in complete or nearly complete graphitization of the fibers. Fibers in excess of 99 percent carbon are known to be produced through this process.

U.S. Pat. No. 5,700,573 teaches a biregional carbon fiber and method of making them. The '573 patent shows a fiber that, instead of being completely carbonized, has an outer carbonized sheath surrounding an inner noncarbonized core. The biregional fiber is produced from a homogeneous polymeric material in which an outer fiber portion of the polymeric material is oxidation stabilized and then carbonized to form two distinct regions in the fiber. A preferred polymeric material for this purpose is a standard acrylic polymer (i.e. copolymers and terpolymers of acrylonitrile, in which the copolymers and terpolymers contain at least 85 mole percent acrylic units and up to 15 mole percent of one or more vinyl monomers copolymerized therewith or optionally a sub-acrylic polymer).

Current production techniques call for batch carbon fiber formation. Therefore, fibers are maintained at an oxidizing temperature in the presence of oxygen for a length of time and then transferred to a non-oxidizing environment, such as an oxygen-free tube furnace, for carbonization or graphitization. As a result, batch carbon fiber production is time consuming.

In addition, U.S. Pat. No. RE34,162 to Boyd, Jr. teaches the continuous carbonization of previously stabilized fibers with the use of a known continuous line carbonizer.

None of the prior art production techniques employ a continuous process for continuously carbonizing the precursor fiber.

SUMMARY OF THE INVENTION

According to the present invention, there is provided a method and apparatus for producing carbon fibers. The method generally comprises the steps of providing a precursor fiber, providing a furnace configured to heat the fiber, stabilizing the precursor fiber and carbonizing the fiber. Stabilization is accomplished by heating the precursor fiber in an oxidizing environment in a heating chamber of the furnace while applying tension to the precursor fiber. The stabilized fiber is carbonized by further heating the fiber in an oxidizing environment in the heating chamber of the furnace.

According to another aspect of the present invention, a method for producing carbon fibers is provided that includes providing a precursor fiber, providing a furnace configured to heat the fiber, then stabilizing and carbonizing the fiber in a single continuous process that includes drawing the fiber continuously through the furnace.

According to another aspect of the present invention, a method for producing carbon fibers is provided that includes providing an elongated precursor fiber and a plurality of furnaces disposed adjacent one another in a serial side-by-side relationship and configured to heat the fiber to different respective temperatures as the fiber is drawn through the furnaces. The precursor fiber is stabilized by heating the precursor fiber in an oxidizing environment as it is passed lengthwise through respective heating chambers of an initial group of the furnaces and while applying tension to the precursor fiber. The stabilized fiber is continuously carbonized by further heating the fiber in an oxidizing environment in the heating chamber of a final one of the furnaces.

According to another aspect of the invention an apparatus for forming carbon fibers is provided that includes a first furnace having a heater and an air supply system configured to direct a gas comprising oxygen over the heater and into a heating chamber. Also included is a fiber guide configured to direct a fiber through the heating chamber. A dispersion plate is disposed between the heater and the heating chamber and is configured to evenly disperse heated air into the heating chamber and around the fiber.

According to another aspect of the invention, an apparatus for forming carbon fibers is provided that includes two or more adjacent furnaces, each having a heater and an air supply system configured to direct a gas comprising oxygen over the heater and into a heating chamber. The heater and air supply system of each successive furnace provide gas at a temperature higher than that produced in respective preceding furnaces. The apparatus also includes a fiber guide configured to direct a fiber through the heating chambers of the furnaces.

The present invention provides a method and apparatus for producing carbon fibers that decreases processing time, carries out the carbonization of stabilized fibers in an oxidizing environment from raw precursor fibers, and allows for continuous carbon fiber production.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE DRAWINGS

Figure 1:
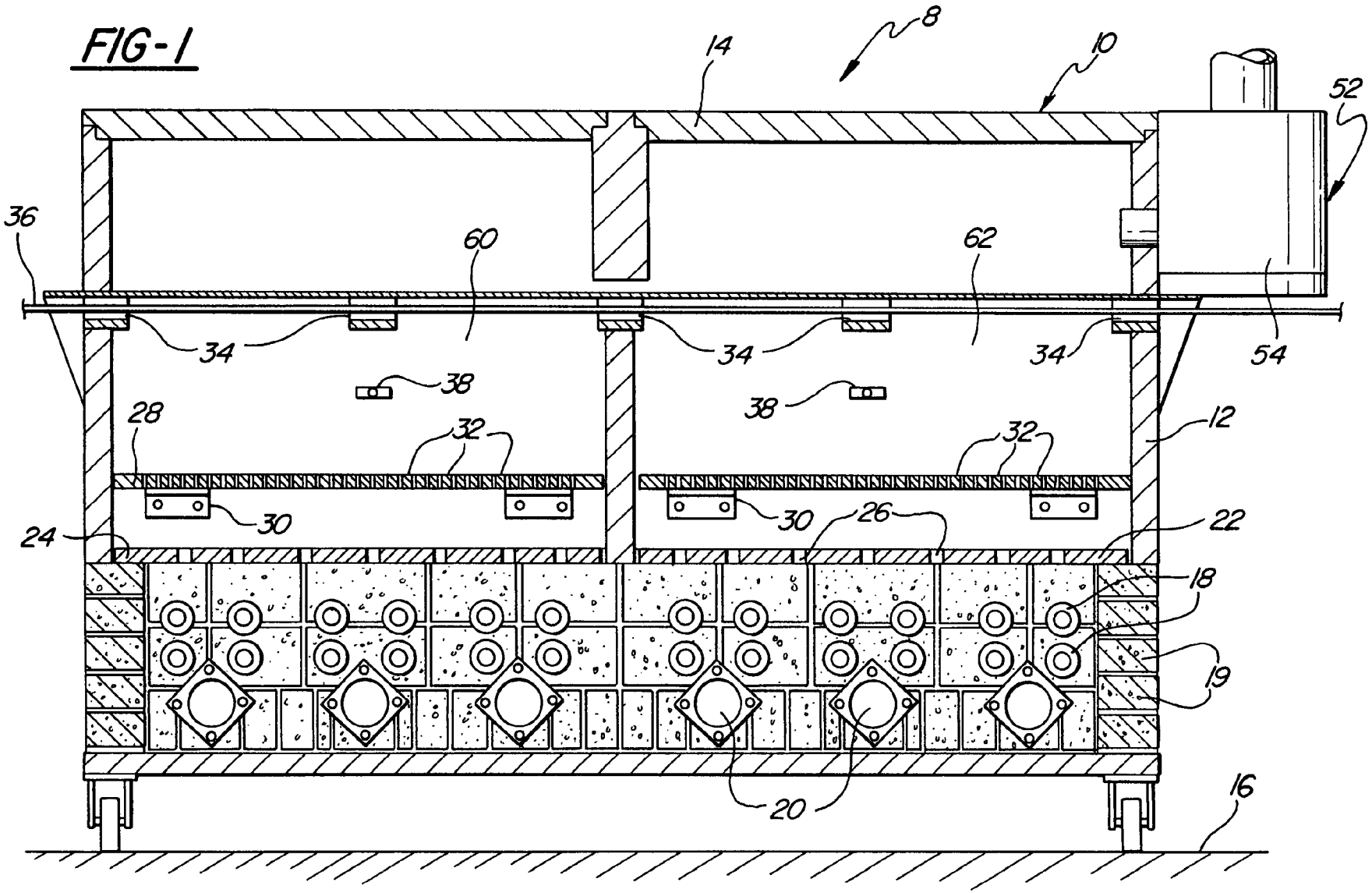
FIG. 1 is a cross-sectional side view of a furnace made in accordance with a first embodiment of the present invention.

An apparatus made in accordance with a first embodiment of the present invention is generally shown at 8 in the Figures. An apparatus made in accordance with a second embodiment of the present invention is shown at 10' in the Figures. Unless indicated otherwise, the following description of elements of the first embodiment also applies to corresponding elements of the second embodiment indicated by the same reference numerals but with the prime (') notation.

As shown in FIG. 1, the first embodiment apparatus 8 includes a furnace 10 having a housing 12 and a pivotable lid 14. The pivotable lid 14 allows for access to an interior of the housing 12 to permit routine maintenance. The housing 12 rests on a support surface 16. In other embodiments, the housing 12 may be supported by fixed legs or by wheels.

At least one and preferably a plurality of heating elements 18 are mounted within the housing 12. The heating elements 18 are located in a lower portion of the housing 12. The heating elements 18 are necessary to raise the temperature within the housing and to maintain the temperature within the housing 12 at a level that allows for either the stabilization or carbonization of fibers disposed within the housing 12. The housing 12 may include bricks 19. The bricks 19 aid in regulating the temperature within the housing.

In the first embodiment, the heating elements 18 comprise electrical rod heaters. However, any type of heating element 18 may be used within the scope of the present invention. For example, the electrical rod heaters may be replaced by other electrical heaters or by gas fire burners.

The housing 12 further includes at least one and preferably a plurality of blower openings 20. The blower openings 20 are evenly spaced and located in a rearmost wall of the housing 12 and allow for air to be blown into the interior of the housing 12. Preferably, ambient air is introduced into the interior of the housing through the blower openings 20, as will be described below.

Figure 4:
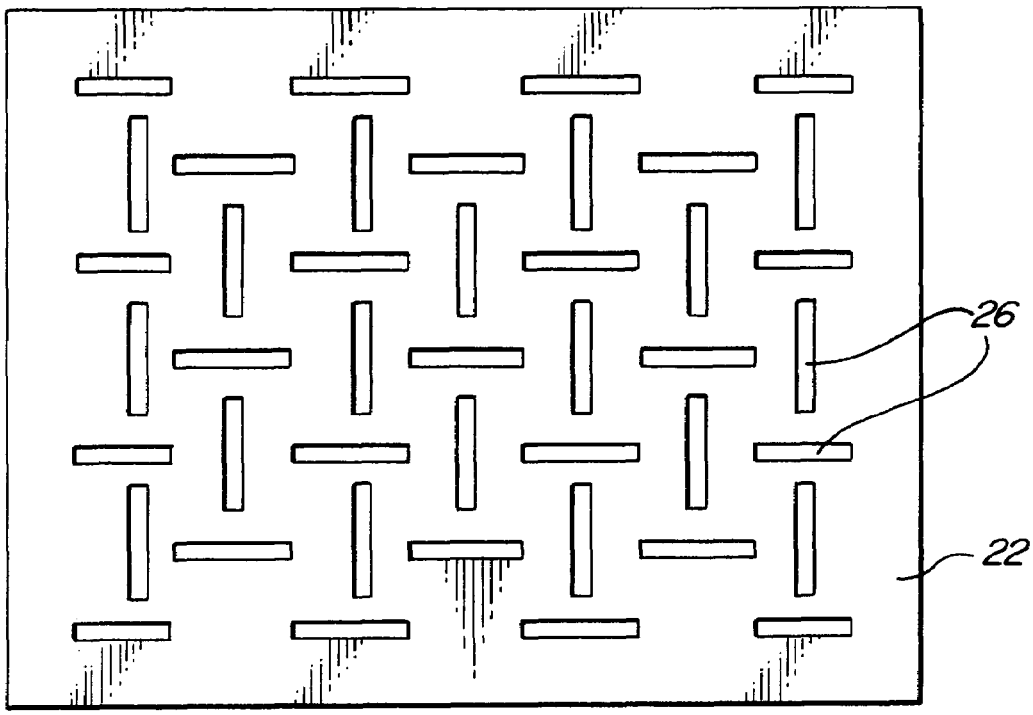
FIG. 4 is a top view of a first dispersion plate of the furnace of FIG. 1.

A first dispersion plate 22 is supported on a suitable support ledge 24 within the housing 12. The first dispersion plate is located within the housing 12 above the heating elements 18. The first dispersion plate 22 can best be seen in FIG. 4. The first dispersion plate 22 has a plurality of symmetrically spaced air passageways 26. The air passageways 26 work to evenly disperse the flow of air entering the housing 12 through the blower openings 20. This first dispersion plate 22 provides a preliminary mechanism for evenly dispersing the flow of heated air that eventually reaches the fiber.

A second dispersion plate 28 is supported on a second support ledge 30 within the housing 12. The second dispersion plate 28 is located above the first dispersion plate 22. The second dispersion plate 28 is preferably spaced from the first dispersion plate 22 by a distance that allows the airflow through the air passageways 26 to become relatively evenly dispersed.

Figure 5:
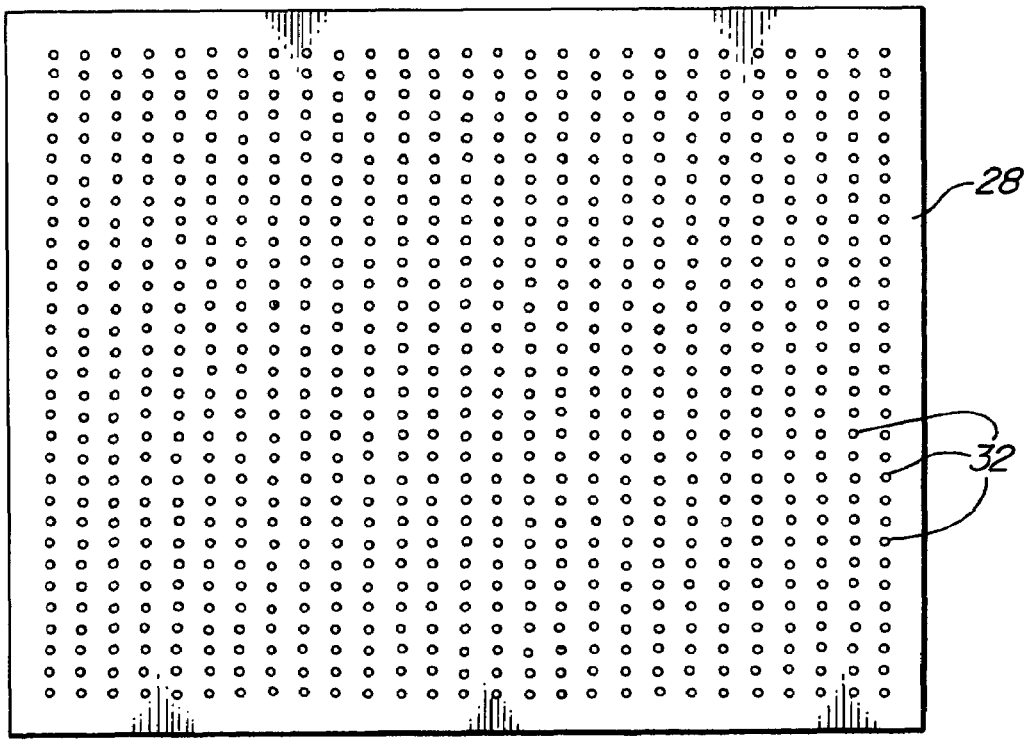
FIG. 5 is a top view of a second dispersion plate of the furnace of FIG. 1.

The second dispersion plate 28 can best be seen in FIG. 5. The second dispersion plate 28 has a plurality of air openings 32. The air openings 32 are symmetrically spaced holes through the dispersion plate 28. The air openings 32 work to evenly disperse the flow of air that reaches the fiber passing above. It is intended that this second dispersion plate 28 will provide a final mechanism for evenly dispersing the flow of heated air over the fiber.

It has been found that by evenly dispersing the flow of air over the fiber, more uniform carbon fibers result. That is, by evenly dispersing the air, a more uniform stabilization of the fiber occurs, and a more uniform carbonization of the fibers results. It will be appreciated that while first and second dispersion plates are disclosed, any manner of dispersing the air over the fiber can be used within the scope of the present invention. For example, the first dispersion plate can be eliminated. Furthermore, it may be possible to eliminate both dispersion plates.

The housing 12 further includes at least one, and preferably a plurality of fiber guides 34. The fiber guides 34 are preferably ceramic. Ceramic fiber guides 34 provide a suitable guide for the fiber, and do not react within the housing 12 to produce undesirable characteristics in the fiber. A fiber 36 is shown supported on the guides 34. The guides 34 support the fiber 36 and allow for movement of the fiber 36.

While reference is made to a fiber 36, it will be appreciated that the fiber can comprise a single strand or multiple strands in close proximity to one another.

The guides 34 support the fiber 36 sufficiently above the second dispersion plate 28 so as to allow evenly dispersed air flow through the air openings 32 over the fiber 36.

The housing 12 further includes at least one temperature probe 38. In the first embodiment, the temperature probe 38 is a thermocouple. The thermocouple is connected to a computer (not shown). The computer is also connected to the heating elements 18. In this manner, the temperature within the housing 12 is continuously monitored and can be held at a constant temperature by adjusting the energy output of the heating elements 18.

The housing 12 may also be insulated (not shown). The insulation will help regulate the temperature within the housing by preventing the transfer of thermal energy between the ambient atmosphere and the interior of the housing 12.

Thus, the furnace generally comprises three zones. The first zone is the heating zone. It is located below the first dispersion plate 22 and is the area where ambient air is introduced and heated to the desired temperature. The second zone is the airflow control zone. This is located between the first and second dispersion plates 22, 28, respectively. In this zone, the heater air is preliminarily dispersed for even distribution to the second dispersion plate 28. The third zone is the fiber reaction zone. This is located above the second dispersion plate 28 and is the area in which the fiber 36 isheated and reacts. The heated air is uniformly dispersed in the fiber reaction zone through the second dispersion plate 28.

Figure 3:
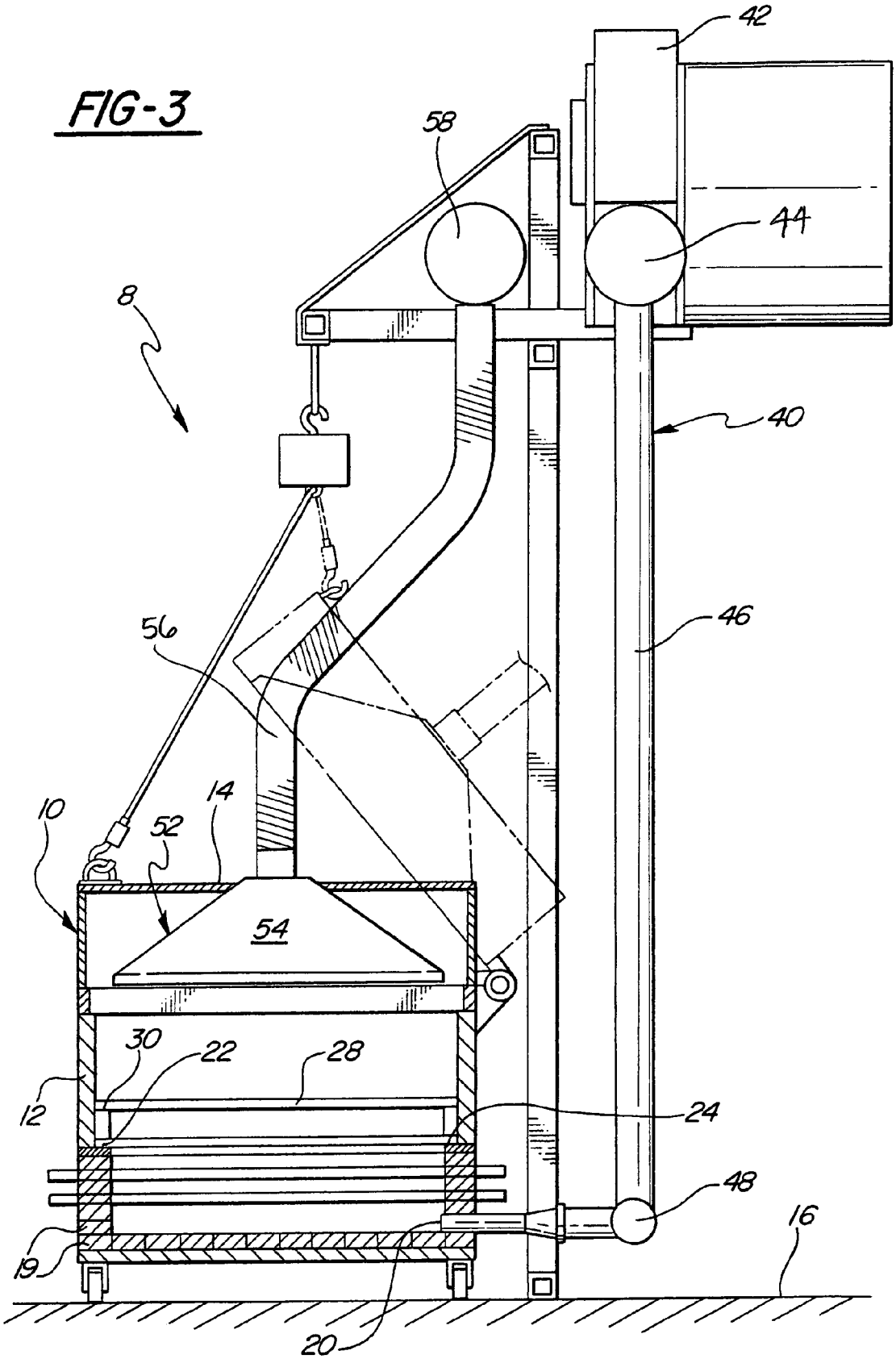
FIG. 3 is an end view of the furnace of FIG. 1.

The furnace 10 has an associated air supply system generally indicated at 40 in FIG. 3. The air supply system is for introducing air into the housing 12 of the furnace 10. The air supply system 40 includes an air intake 42. A blower 44 is connected to the intake 42. Ductwork 46 connects the blower with the blower openings 20 in the housing 12. As can be seen in FIG. 3, the ductwork 44 includes a manifold 48 that distributes the air from the ductwork to the blower openings 20 through lower ducts 50. Thus, each of the lower ducts 50 is connected at one end to the manifold 48 and at the opposite end to the blower openings 20 in the housing 12.

The air supply system 40 preferably introduces ambient air to the housing 12, as ambient air is readily available and carries enough oxygen to carry out the stabilization and carbonization of the fibers. However, the level of oxygen supplied by the air supply system 40 can be adjusted by controlling the output of the blower 44 to regulate the volume of air introduced to the housing 12. In this manner, the level of oxygen supplied to the furnace can be easily controlled. If desired, additional oxygen can be introduced to the housing.

The furnace 10 also has an associated venting system, generally indicated at 52 in FIGS. 1 and 3. It is necessary to vent the housing 12 in order to prevent heat build up in the housing 12 and to expel the gaseous byproducts of the stabilization and carbonization processes.

The venting system 52 includes a collector 54 at one end of the housing 12. The collector 54 is connected to an opening in the housing 12. The collector 54 is connected via ducting 56 to a venting blower motor 58. The venting blower motor 58 induces airflow through the venting system 52 to remove the gasses from the interior of the housing 12. The removed gasses may be further processed if necessary to remove any harmful gasses and then exhausted to the atmosphere.

While the venting system is preferably located at the side of the housing 12, it can be located on the top 14 of the housing 12.

Figure 2:
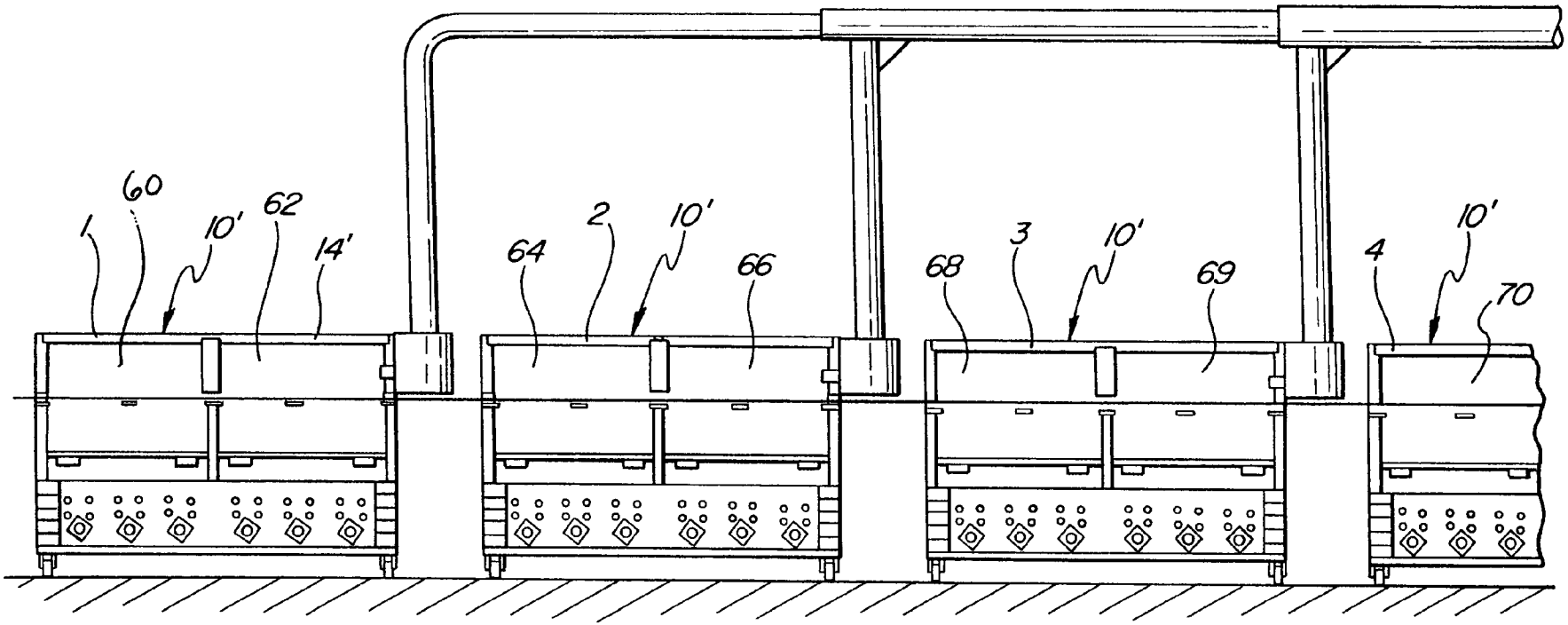
FIG. 2 is a partial schematic side view of an apparatus made in accordance with the present invention that includes seven of the furnaces of FIG. 1 connected in series.

The furnace 10 for producing the carbon fibers has now been described in detail. As described below, only a single stage furnace is necessary to carry out the carbonization of the precursor fibers. If a single stage furnace is used, the carbonization takes place in various steps within the furnace 10, and the process proceeds in a batch-like fashion. However, it may be advantageous to place several furnaces together in a side-by side relationship, as shown in FIG. 2. By placing the furnaces in this orientation, the carbonization of the precursor fiber can take place in a continuous fashion.

As shown in FIGS. 1 and 2, it may also be advantageous to include two or more temperature stages or chambers 60, 62 within each furnace 10. The independent temperature stages allow each furnace to expose precursor fibers 36 to different temperatures as the fibers pass through each furnace 10.

If a single furnace is used, the precursor fiber 36 is introduced into the housing 12 of the furnace 10. The temperature inside the furnace is initially about 174 to 185 degrees Celsius. The precursor fiber is preferably a PAN type fiber as described above. The precursor fiber may be crimped or may be straight.

The heated air is blown over the precursor fiber 36. The precursor fiber is held at this temperature for about 5 minutes until the material begins to stabilize.

After the precursor material begins to stabilize (or become temperature receptive) the temperature within the housing 12 is gradually raised (about 1.7 –2.8 degrees Celsius per minute) until the temperature reaches about 204 degrees Celsius. Ambient air is still introduced to the housing 12 through the blower openings 20.

At this stage, the precursor material is stabilized. The stabilized material is then gradually heated by increasing the temperature within the housing 12. Ambient air continues to be fed into the housing 12. The temperature is gradually raised to about 227 to 232 degrees Celsius at a rate sufficient for stabilization but insufficient for carbonization.

Next, through the introduction of heated ambient air, the temperature in the housing is quickly raised to about 399 degrees Celsius at a rate that will both carbonize and purify the fibers. This is the stage at which carbonization of the fiber takes place.

It has been found that by using this process, the carbonization of the stabilized fiber can be conducted without the need to use an inert atmosphere. While there may be no need to introduce addition air during the carbonization phase, there is no need to transport the stabilized fiber to an inert atmosphere. The continued use of the air, however, helps to separate the fibers to prevent melting of the fibers. It also allows the heat to encircle all of the fibers to help the carbonization take place in a uniform manner. It will be appreciated that within the scope of the present invention, the ambient air only need be introduced in the stabilization phase.

Further, the precursor fiber is carbonized under tension. It has been found that the tension will help straighten out the fibers and aids in the absorption of oxygen.

One primary benefit to the method of the present invention is that multiple furnaces 10 can be placed in side-by-side relationship to carry out a continuous carbonization process as shown in FIG. 2. Heretofore, it has not been possible to carry out complete carbonization, from precursor fiber to carbon fiber, in a continuous process. The use of multiple heating stages and the elimination of the need for an inert atmosphere allows for continuous carbonization.

FIG. 2 shows a representative portion of one embodiment of a multi-furnace apparatus that allows for the continuous carbonization of the precursor fiber 36. Seven furnaces 10 are connected in series. Each of the furnaces 10 is as set forth above.

The furnace 10' of the second embodiment includes a series of rollers or stationary pins 66 configured and supported in positions to cause each portion of a fiber 36 passing through the furnace to travel a longer distance before it exits the furnace. The number and positions of the rollers 66 can be adjusted to control the relative amount of time that each portion of a fiber 36 will spend in each such furnace.

In practice, a precursor fiber 36, preferably a PAN type fiber, enters the apparatus 10 in a first one of the furnaces and passes continuously through each of the furnaces in series. The first furnace (given No. 1 in FIG. 2) is set at an initial temperature of about 185 degrees Celsius. The length of the furnace 10 and the draw rate of the precursor fiber through the apparatus determine the residence time of the fiber in the furnace 10.

The heated fiber then moves to the second furnace 10 in the apparatus (given No. 2 in FIG. 2). In the second furnace, the temperature is set at about 193 degrees Celsius. At this point, the precursor material starts to stabilize.

The fiber then moves to a third furnace, which is at a temperature of about 204 degrees Celsius, where further stabilization occurs.

The fiber is then processed in the fourth furnace, which is at a temperature of about 216 degrees Celsius.

The fiber then moves to the fifth and then the sixth furnaces (not shown). The temperature of both of these furnaces is about 232 degrees Celsius. Both the fifth and the sixth furnaces are held at 232 degrees Celsius because it allows the fibers more time to stabilize at a temperature that is just below the flash point of the fibers. Alternatively, a roller system, such as the one shown at 66 in FIG. 6, may be used in the fifth furnace instead of running the fibers through a second furnace at the same temperature. The roller system 66 in such an embodiment can be configured to extend fiber exposure to this temperature for a desired period of time.

Finally, the heated stabilized fiber 36 is moved to the seventh furnace (not shown), which is at a temperature of about 260 degrees Celsius. It is in this furnace that carbonization of the fiber takes place.

Figure 6:
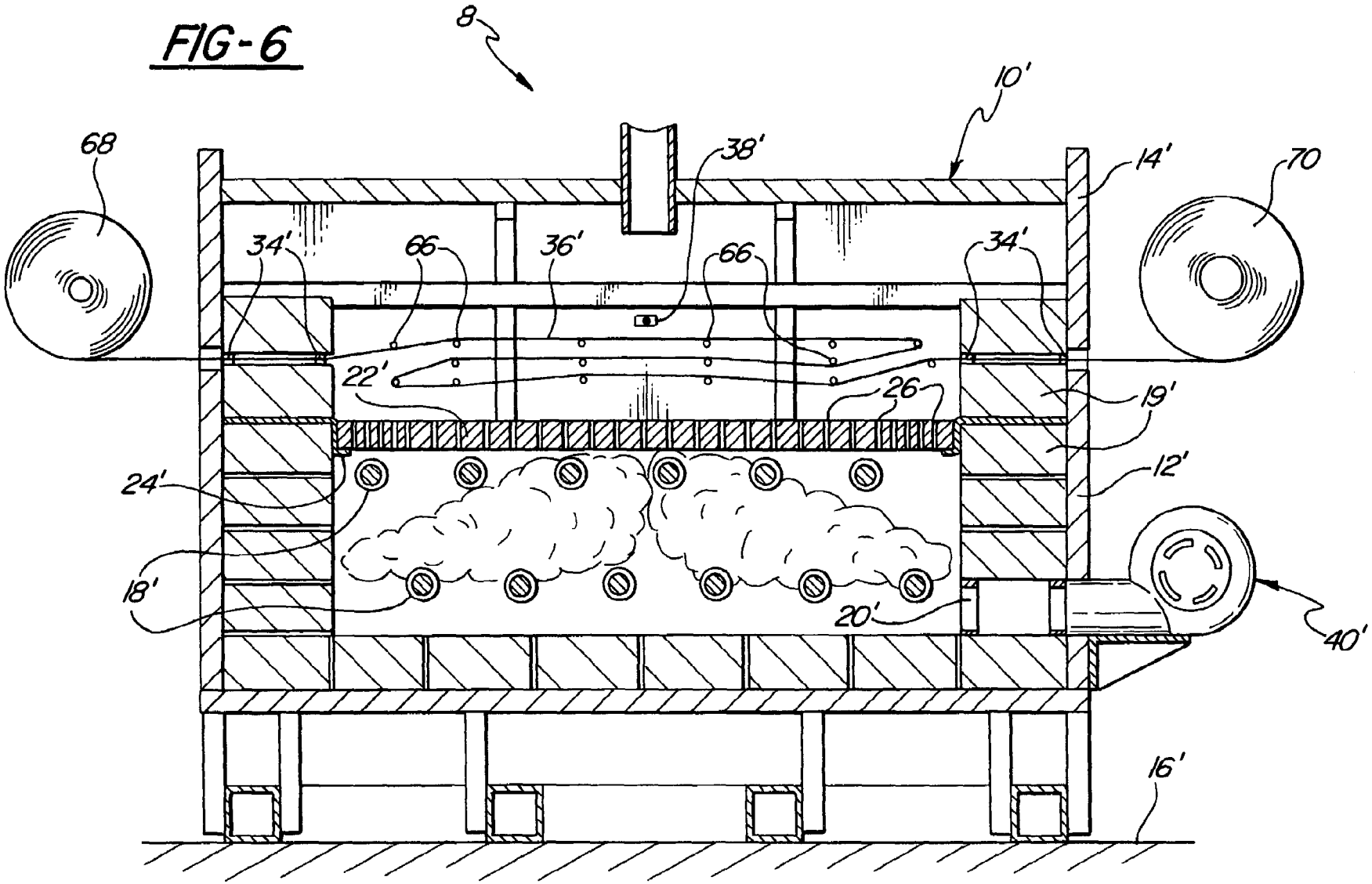
FIG. 6 is a cross-sectional side view of a furnace made in accordance with a second embodiment of the present invention.

The carbonized fiber then is taken up on a take-up spool such as the spool shown at 68 in FIG. 6. The take-up spool 68 and or a feed out spool 70 may include a puller to impart tension on the fiber and to impart a consistent draw rate of the fiber through the furnaces.

Again, the residence time of the fiber 36 within each furnace is a function of the draw rate of the fiber through the furnaces 10 and the length of the furnaces. The furnaces provide gradual heating of the precursor fiber 36 to allow the fiber to stabilize and then to carbonize. This apparatus allows for the continuous carbonization of the precursor fiber. Further, complete graphitization may be obtained by adding additional furnaces operating at higher temperatures.

In the first embodiment, the draw rate is about 10 ft./minute. The residence time in each furnace is about 0.6 minutes. Thus, the furnaces have a length of about 7 feet. Again, any draw rate can be used to optimize the stabilization and carbonization processes.

In the first embodiment, ambient air is introduced into each furnace. It is not necessary to introduce air in the furnaces where the temperature is about 232 degrees Celsius or above. However, as described above, the addition of air provides certain advantages. However, the amount of air introduced into these furnaces can be adjusted downward to reduce the amount of ambient air supplied to the furnace. For example, the airflow in these furnaces can be restricted to about 60 percent (by volume) of the airflow in the furnaces operating below 232 degrees Celsius. In this manner, airflow is decreased, but allows for the separation of adjacent fibers and the even distribution of heat about the fibers.

The fiber 36 can be exposed to additional ambient air between the furnaces. That is, it may be desirable to expose the fiber to ambient air between adjacent of the furnaces. The relatively cooler ambient air may expose the fiber to additional oxygen thus aiding in the stabilization and carbonization reactions. Thus, it will be appreciated that the fiber may be exposed to ambient air between adjacent of the furnaces.

Alternatively, if desired, the fiber can be shielded from the ambient air by enclosing the fiber as it passes between adjacent of the furnaces. Thus the fiber may be exposed between all furnaces, shielded between all furnaces, or exposed between some furnaces and shielded between others. Whether to expose the fiber between adjacent furnaces is a matter taken into consideration for optimizing the process.

Carbonization can also be achieved using a series of fourteen separate heating stages as is representatively shown in FIG. 2. Each of the successive furnace stages (60, 62, 64, 66, 68, 70 . . . ) is heated to a predetermined higher temperature than their respective preceding stages. This subjects fiber precursors drawn through the stages to multiple stepwise increases in temperature that gradually achieve temperature resistance in preparation and then finally carbonize the fibers. Staged temperature increases provide much quicker fiber stabilization than can a gradual temperature increase. This is because each temperature stage quickly raises the fiber or fibers passing through it to the highest temperature the fiber can withstand at each point in the stabilization process. Therefore, an equal amount of thermal energy can be transferred into the fiber or fibers in a shorter period of time.

For PAN fibers, thirteen of the fourteen heating stages are used to stabilize the fibers at a final stabilization temperature of 427 degrees Celsius. The temperatures are: in stage one, 185.0 degrees; in stage two, 187.8 degrees; in stage 3, 190.6 degrees; in stage 4, 193.3 degrees; stage 5, 196.1 degrees; stage 6, 198.9 degrees; stage 7, 201.7 degrees; stage 8, 204.4 degrees; stage 9, 232.2 degrees; stage 10, 260.0 degrees; stage 11, 287.8 degrees; stage 12, 315.6 degrees; and stage 13, 371.1 degrees Celsius. The fourteenth and final stage then carbonizes the fibers by quickly heating them to 537.8 degrees Celsius.

PAN fibers are transferred through the furnaces at a continuous fiber transfer rate of 10 feet per minute. However, other embodiments may use different fiber transfer rates to accommodate temperature resistance characteristics of different fiber precursor materials.

The degree of carbonization of the fiber can be controlled by adjusting the fiber residence time within the furnaces. It is not necessary to fully carbonize the fiber. In some instances it may be desirable to carbonize an outer circumferential portion of the fiber, thus leaving a biregional fiber having an outer circumferential carbonized region, and an inner virgin material core region. To accomplish this, enough oxygen has to be delivered into the outer circumferential portion during stabilization to support oxidation. Also, it is possible to carbonize a bipolymeric fiber wherein the fiber contains inner core(s) of one polymer and an outer sheath which can be oxidatively stabilized or carbonized in accordance with the method set forth above.

Thus, the number of furnaces, length of the furnaces, operating temperatures of the furnaces and draw rate can all easily adjusted to optimize the carbonization of the precursor fibers.

The invention is described in an illustrative manner. The terminology is intended to be in the nature of description rather than of limitation.

Obviously, many modifications and variations of the present invention are possible in light of the above teachings. It is, therefore, to be understood that within the scope of the appended claims, the invention may be practiced otherwise than as specifically described.

What is claimed is:

1. A method for making carbon fibers, the method including the steps of:

providing a precursor fiber;

providing a furnace configured to heat the fiber;

stabilizing the precursor fiber by heating the precursor fiber in an oxidizing environment in a heating chamber of the furnace while applying tension to the precursor fiber;

carbonizing the stabilized fiber by further heating the fiber in an oxidizing environment in the heating chamber of the furnace.

2. The method of claim 1 in which the steps of stabilizing and carbonizing each include:

continuously introducing ambient air into the furnace;

heating the air; and blowing the heated air over the fiber in the heating chamber of the furnace.

3. The method of claim 1 in which the step of stabilizing includes:

initially heating the precursor fiber until reaching a heating chamber temperature of between approximately 174 and 185 degrees Celsius;

holding the heating chamber at this temperature for approximately 5 minutes until the material begins to stabilize;

after the precursor material begins to stabilize, raising the heating chamber temperature approximately 1.7–2.8 degrees Celsius per minute to approximately 204 degrees Celsius by increasing the temperature of the heated air being blown into the heating chamber; then gradually raising the heating chamber temperature from approximately 204 degrees Celsius to approximately 227 to 232 degrees Celsius by increasing the temperature of the heated air being blown into the heating chamber at a rate sufficient for stabilization but insufficient for carbonization; and the step of carbonizing includes:

quickly raising the heating chamber temperature to approximately 399 degrees Celsius by increasing the temperature of the air being introduced into the heating chamber at a rate that will carbonize the fiber.

4. The method of claim 1 in which the step of carbonizing includes carbonizing the fibers such that each resulting fiber is a biregional fiber that includes an inner non-carbonized core and an exterior carbonized sheath.

5. The method of claim 4 in which:

the step of providing precursor fibers includes providing a homogeneous polymeric material;

the step of stabilizing includes oxygen stabilizing an outer fiber portion of the polymeric material; and the step of carbonizing includes forming a carbonized outer region and a non-carbonized inner region of each fiber.

6. The method of claim 5 in which the step of providing a homogeneous polymeric material includes providing a standard acrylic polymer.

7. The method of claim 1 in which the step of providing a precursor fiber includes providing a polyacrylonitrile (PAN) fiber.

8. A method for making carbon fibers, the method including the steps of:

providing an elongated precursor fiber;

providing at least seven furnaces disposed adjacent one another in a serial side-by-side relationship, connected in series, and configured to heat the fiber to different respective temperatures as the fiber is drawn through the furnaces;

introducing ambient air into each furnace;

heating the heating chamber of the first furnace to approximately 185 degrees Celsius;

heating the heating chamber of the second furnace to approximately 193 degrees Celsius;

heating the heating chamber of the third furnace to approximately 204 degrees Celsius;

heating the heating chamber of the fourth furnace to approximately 216 degrees Celsius;

heating the heating chambers of the fifth and sixth furnaces to approximately 232 degrees Celsius; and stabilizing the precursor fiber by heating the precursor fiber in an oxidizing environment as it is drawn through the respective heating chambers of the first, second, third, fourth, fifth, and sixth furnaces in sequence while applying tension to the precursor fiber;

heating the heating chamber of the seventh furnace to approximately 260 degrees Celsius;

continuously carbonizing the stabilized fiber by further heating the fiber in an oxidizing environment as it is drawn through the heating chamber of the seventh furnace; and adjusting downward the amount of ambient air introduced into furnaces that are operating at and above approximately 232 degrees Celsius.

9. The method of claim 8 including the additional step of restricting the airflow in furnaces operating at and above 232 degrees Celsius to approximately 60 percent (by volume) of the airflow in the furnaces operating below 232 degrees Celsius.

* * * * *

UNITED STATES PATENT AND TRADEMARK OFFICE

CERTIFICATE OF CORRECTION

PATENT NO. : 7,223,376 B2
APPLICATION NO. : 09/780303
DATED : May 29, 2007
INVENTOR(S) : Ronald L. Panter and Thomas A. Herold It is certified that error appears in the above-identified patent and that said Letters Patent is hereby corrected as shown below:

Re-insert CLAIM 8 as allowed --8. A method for making carbon fibers, the method including the steps of: providing a precursor fiber; providing a furnace configured to heat the fiber for both stabilization and carbonization of the fiber; and stabilizing and carbonizing the fiber in a single continuous process that includes drawing the fiber continuously through the furnace by engaging and applying a continuous pulling force to the fiber from outside the furnace.--

Renumber "Claim 8" as --Claim 9--

Renumber "Claim 9" as --Claim 10--

Signed and Sealed this

First Day of June, 2010

David J. Kappos

David J. Kappos
*Director of the United States Patent and Trademark Office*